United States Patent [19]

D'Angelo et al.

[11] Patent Number: 4,645,534

[45] Date of Patent: Feb. 24, 1987

[54] PROCESS FOR CONTROL OF CONTINUOUS CASTING CONDITIONS

[75] Inventors: Renato D'Angelo, Guidonia Montecelio; Aldo Ramacciotti, Rome; Eugenio Repetto, Rome; Pietro Tolve, Rome, all of Italy

[73] Assignee: Centro Sperimentale Metallurgico S.p.A., Rome, Italy

[21] Appl. No.: 790,231

[22] Filed: Oct. 22, 1985

[30] Foreign Application Priority Data

Oct. 25, 1984 [IT] Italy ..... 49069 A/84

[51] Int. Cl.[4] ..... C21C 5/52

[52] U.S. Cl. ..... 75/10.22; 164/505; 266/236

[58] Field of Search ..... 266/236, 237; 75/49, 75/13, 10 R; 164/505

[56] References Cited

U.S. PATENT DOCUMENTS 3,523,785 8/1970 Gero ..... 266/237

*Primary Examiner*—Peter D. Rosenberg

*Attorney, Agent, or Firm*—Young & Thompson

[57] ABSTRACT

A process for controlling continuous casting conditions in steel tapped from a furnace, which proceeds from a ladle into a tundish, and then via a submerged nozzle to a continuous casting mold. In either the ladle or the tundish, the liquid steel is subjected to radiation heating and convection heating from an electric heating device by which an electric current is made to pass through the liquid steel from this heating device to a return located downstream of the device, for example in the continuous casting mold. Preferably, the heating device is a transferred arc plasma torch. In addition, the nozzle between the tundish and the continuous casting mold is subjected not only to the passage of current but also to a direct magnetic field perpendicular to the steel stream.

4 Claims, 1 Drawing Figure

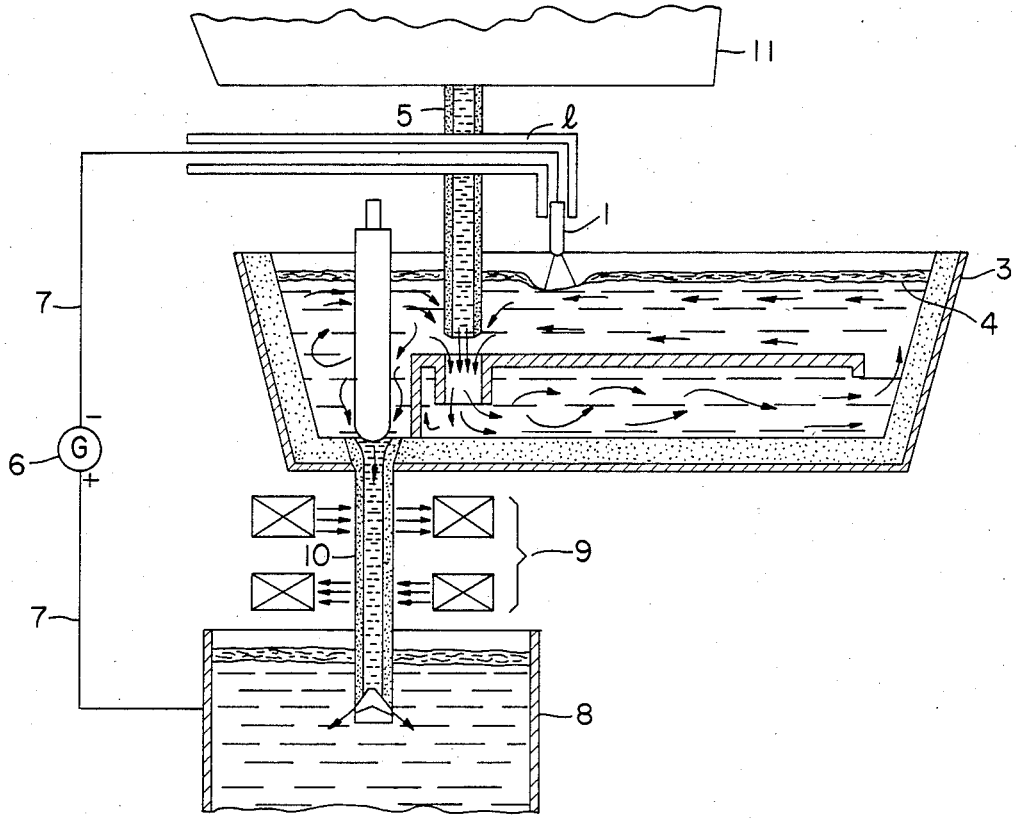
11
5
ℓ
1
3
4
7
6
G
−
+
10
9
7
8

PROCESS FOR CONTROL OF CONTINUOUS CASTING CONDITIONS

DESCRIPTION

The present invention concerns a process for controlling continuous casting conditions. In particular, it relates to means for monitoring and controlling the temperature of the liquid steel in the ladle and/or the tundish, as well as in the nozzle. As an additional benefit, the invention ensures a more regular flow of steel through the nozzle.

Continuous casting of steel is a well-known, widely-practised process. However, the most recent technological and economic aspirations to ensure higher casting speeds and better semifinished cc product quality (e.g. less segregation and a smaller number of surface and internal defects, such as cracks, axial porosity and the like, as well as solidification structures), have not really found a satisfactory answer so far.

The solution of these problems is of prime importance, however, not only because of the desirability of improving quality but also because of the further technological developments that could ensue. For instance, the possibility of extending the practice of direct rolling of the cc semi, which at the moment is employed by only a few steelmakers, or even the possibility of continuous casting of thin products (i.e. those a few centimetres thick) to be hot-rolled directly into strip, would be really radical innovations which would provide the steel industry with very marked economic benefits that could help it ride out the present highly critical situation. In very general terms, it is reasonable to assume that most of the quality problems affecting cc semis are attributable to fluctuations or variations in continuous casting conditions. Two of the operating conditions universally recognized as being the most important are the temperature and the flow rate of the liquid steel when it reaches the mould of the cc machine. It is considered essential to ensure that these parameters are as constant as possible.

However, where temperature is concerned, it is evident that the steel must be cast at a temperature higher than that of the liquidus. This difference in temperature, known as superheat, must be great enough to permit the regular progress of the casting operation, but at the same time it must be as small as possible, for two reasons. The first is that the cost of raising the temperature in the electric furnace is high, owing to the relatively low efficiency of this unit, namely around 30%. The second is that the process of solidification of the steel in the mould has a marked influence on the quality of the resulting semi, solidification, in turn, being influenced by the superheat, correctly considered as being the fundamental parameter controlling the final structure. It has been ascertained, in particular, that a superheat of less than 10° C. greatly improves the situation as regards segregation.

Another important parameter is uniformity of the temperature of the cast steel. It has been found that fluctuations of temperature during continuous casting cause uneven solidification which, in turn, leads to the formation of longitudinal surface cracks and porosity and of central cracks.

Moreover, in high-speed continuous casting, excessive superheat and possible temperature fluctuations result in insufficient formation of a solid skin and so there is the risk of cracks, especially on the corners, or even breakouts.

It is evident from this rapid review that continuous casting must be performed at a known superheat which is fixed and as low as possible. However, under such circumstances there is the risk that the steel will solidify before it is cast, especially in zones where heat dispersion is the greatest, such as in the nozzle. Of course, the lower the superheat the greater this risk.

The solutions proposed so far to this problem have not been entirely satisfactory, for a variety of reasons. For instance, it has been proposed that the steel in the ladle or the tundish should be kept hot by means of arc electrodes or by resistances buried in the walls of these containers. However, apart from the low thermal efficiency of these sytems, which make them too costly, there remains the problem of solidification of the steel in the nozzle, which is always possible, at least at the start of casting, if the superheat is kept at appropriately low levels.

The object of this invention is to overcome these difficulties by a simple, effective process which enables the steel to be tapped from the furnace at a significantly low temperature, of continuously casting this steel at a fixed, minimum superheat, of preventing partial or complete blockage of the nozzle by the solidified steel and, perhaps, of delaying the formation of nonmetallic occlusions in the nozzle.

In a continuous casting plant where the steel is tapped from the furnace into a ladle, from whence it is poured into a tundish, from which it is delivered to the continuous casting mould via a submerged snorkel, the process as per this invention is characterized by the fact that the liquid steel contained in at least one of said containers—ladle or tundish—upstream of the cc mould is subjected to radiation and convection from an electrically-powered heating device, and by the fact that a current is caused to pass through the liquid steel between said heating device and the cc mould. Alternatively, if considered possible and necessary, the current can flow between said heating device and an appropriate element downstream such as, for instance, the nozzle or parts of the continuous casting machine located downstream of the mould or even the cast, solidified semi itself. These alternative solutions remain within the orbit of the present invention since, as will be evident ahead, the fact that current of adequate amperage also flows through the steel which passes through the nozzle between the tundish and the mould is of particular importance according to this invention.

This electric heating device consists preferably of a transferred arc plasma torch, because of its high thermal efficiency and its many control possibilities.

Finally, according to the invention, it is also possible for the steel flowing through the nozzle between the tundish and the mould to be subjected to a direct magnetic field perpendicular to the direction of flow of the steel, so that this magnetic field, together with the current flow perpendicular thereto, causes forces which agitate the steel within the nozzle, thus preventing the build-up of nonmetallic impurities which could cause a blockage there; and by appropriately adjusting this magnetic field and/or the current flowing in the nozzle, it is also possible to exert some control over the flow rate of the steel through the nozzle.

This invention ensures numerous benefits, namely:

the possibility of tapping steel from the furnace at the minimum superheat compatible with the holding times between tapping and continuous casting the possibility of maintaining a minimum, constant superheat during casting maintenance of said superheat at minimum operating cost because of the high thermal efficiency of the plasma torch thanks to the fact that by means of the transferred arc torch, high amperage current passes through the liquid steel, especially that flowing through the nozzle, it is possible to exploit the Joule effect to ensure additional heating of the steel in the nozzle, so as to avoid blockage by the steel which could solidify owing to the minimum superheat.

Control of the temperature of the liquid steel before it enters the mould and particularly in the tundish nozzle is assured, of course, by well-known devices that consequently also control the torch-operating parameters—voltage, current, gas flow and distance from bath—so as to keep the superheat value constant.

As indicated earlier, another important parameter which governs semiproduct quality is uniformity of temperature. Of course, during continuous casting, especially in large installations, temperature differences may occur even within the ladle itself. This inhomogeneity inevitably gets transferred to the mould, thus nullifying all the benefits deriving from this invention. Use of a special tundish, described in Italian Patent Application No. 48151 A/84, filed by the Centro Sperimentale Metallurgico SpA, ensures excellent homogenization of liquid steel composition and temperature, and completely eliminates the drawbacks mentioned.

In a series of practical trials as per this invention performed at works scale on a 25 t/h continuous casting line, it was possible to lower superheat in the furnace by 40° C., to subject the steel to a series of ladle treatments, and to keep it in the tundish at a constant superheat of 7°-8° C., while exploiting the Joule effect to provide additional heating in the nozzle ranging from 1° to 10° C., as desired.

Trials run on a 50 t/h continuous casting machine have demonstrated the possibility of obtaining similar results, using higher currents, of course.

Owing to the limited power of the torch available, it was not possible to operate on larger continuous casting plants. However, projections of available data to a cc machine having a capacity of 150 t/h/strand indicate the feasibility of obtaining temperature increases of 1°-2° C. in the nozzle by the Joule effect with currents of around 15,000 A, while also reducing and controlling superheat in the tundish and/or ladle with a torch of adequate capacity.

It ensues from these preliminary trials that operating as per this invention ensures a decided improvement in segregation, a reduction of at least 30% in dendritic structure, the almost complete elimination of axial defects such as porosity and shrinkage cavities, plus a marked decrease—around 50%—in cracks on the faces and corners of the resulting cc semis.

The accompanying drawing is a schematic cross sectional view of a continuous casting plant according to the present invention.

In the drawing, there is shown a transferred arc plasma torch 1 mounted on a water-cooled arm 2, directed downwardly into a tundish 3 and striking the molten steel in the tundish 3 whose level is indicated at 4.

Steel is fed to tundish 3 through nozzle 5 from a ladle 11, and passes thence via a conventional route through a submerged nozzle 10 into continuous casting mold 8.

A DC generator 6 has its terminals respectively connected to the plasma torch 1 and the metallic continuous casting mold 8. The circuit from generator 6 is completed through the molten steel in the tundish 3, the submerged nozzle 10 and the continuous casting mold 8.

A magnetic field generator 9 applies its line of force perpendicular to the stream of molten steel in nozzle 10. Generator 9 is optional. If used, it can have a power between 5 and 15 KVA and a frequency of oscillation of its magnetic field of 5 to 10 Hz.

We claim:

1. In a process for controlling continuous casting conditions, in which steel tapped from a furnace is run into a ladle, and from the ladle, at a continuous casting station, is discharged into at least one tundish from which it is transmitted to a continuous casting mold via a submerged nozzle; the improvement comprising subjecting the molten steel in at least one of the ladle and tundish to radiation heating and convection heating from an electrical heating device by causing an electric current to pass from said device through the liquid steel to a return located downstream of said device with respect to the direction of flow of the liquid steel.

2. Process as claimed in claim 1, in which said heating device is a transferred arc plasma torch disposed above the surface of the liquid steel and directed downwardly against the surface of the liquid steel.

3. Process as claimed in claim 1, in which said downstream electric current return occurs via the continuous casting mold.

4. Process as claimed in claim 1, and subjecting the steel flowing through the nozzle between the tundish and the continuous casting mold not only to the passage of said electric current but also to a direct magnetic field perpendicular to the direction of flow of the steel stream through the nozzle.

* * * * *